United States Patent [19]

Françon et al.

[11] 4,109,503

[45] Aug. 29, 1978

[54] METHOD FOR MANUFACTURING METALLIC RIBS ON SHEET STOCK

[76] Inventors: Jean Françon, rue de la Veronniere; Francis Françon, rue Ennemond Richard, both of 42400 Saint-Chamond, France

[21] Appl. No.: 764,969

[22] Filed: Feb. 2, 1977

[30] Foreign Application Priority Data

Feb. 2, 1976 [FR] France ..... 76 03795
Jun. 15, 1976 [FR] France ..... 76 19008

[51] Int. Cl.[2] ..... B21C 37/02
[52] U.S. Cl. ..... 72/352; 72/379; 113/116 Z; 428/183
[58] Field of Search ..... 72/379, 385, 352, 348; 428/182, 183, 184; 113/116 Z; 156/205

[56] References Cited

U.S. PATENT DOCUMENTS

| | | | |
|---|---|---|---|
| 1,771,028 | 7/1930 | Bronson et al. | 72/379 |
| 2,199,377 | 4/1940 | Tangerman | 72/379 X |
| 3,824,664 | 7/1974 | Seeff | 72/379 |
| 3,902,348 | 9/1975 | Hale | 72/379 |

*Primary Examiner*—Leon Gilden
*Attorney, Agent, or Firm*—Eric P. Schellin

[57] ABSTRACT

There is disclosed a planar sheet having at least one longitudinal corrugation for substantially the entire width of the panel. On at least one end portion of the sheet the corrugation terminates into a plurality of smaller gathered corrugations resulting in closed ends. Apparatus is also disclosed for producing the aforementioned smaller gathered corrugations including an anvil having appropriate cavities therein and a punch system for upsetting a corrugated panel to produce said mini-corrugation.

11 Claims, 16 Drawing Figures

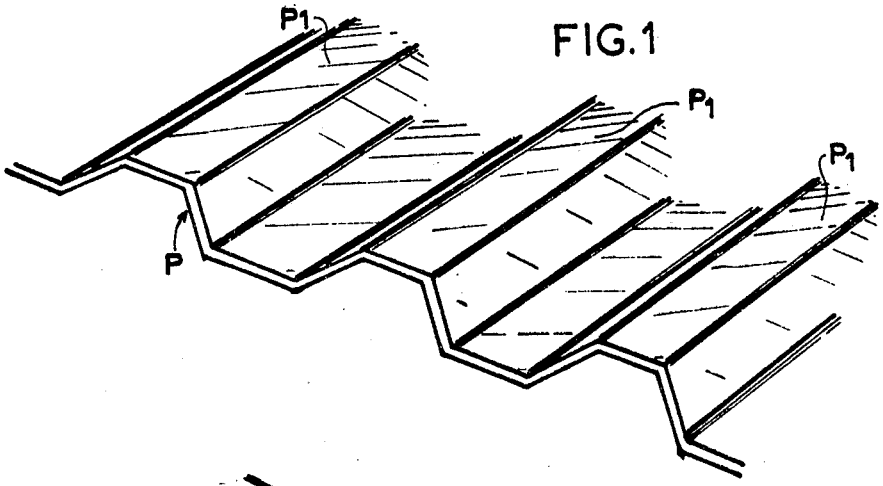
FIG.1
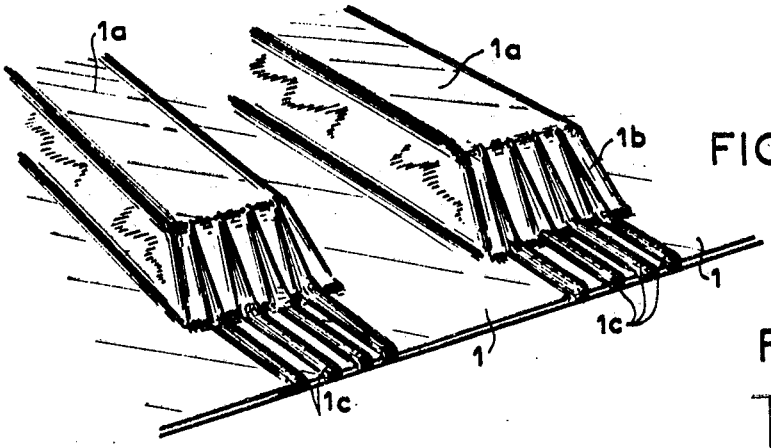
FIG.2
FIG.4
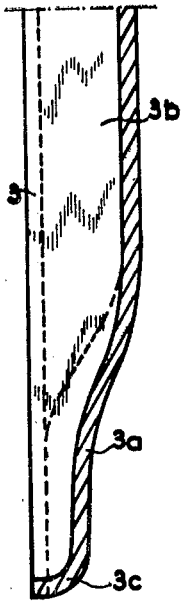
FIG.3
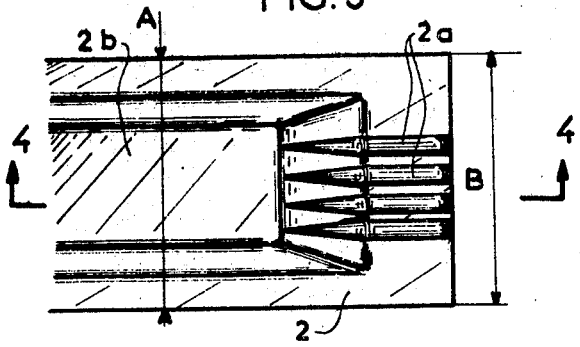

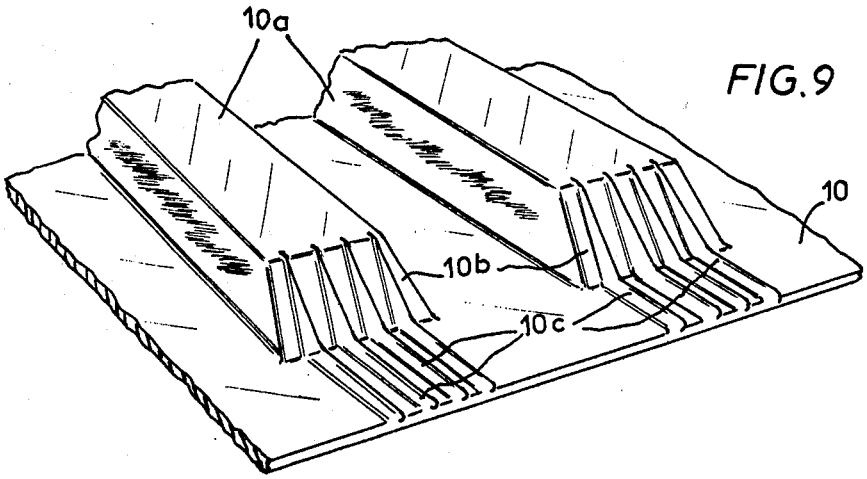
FIG.9
FIG.10
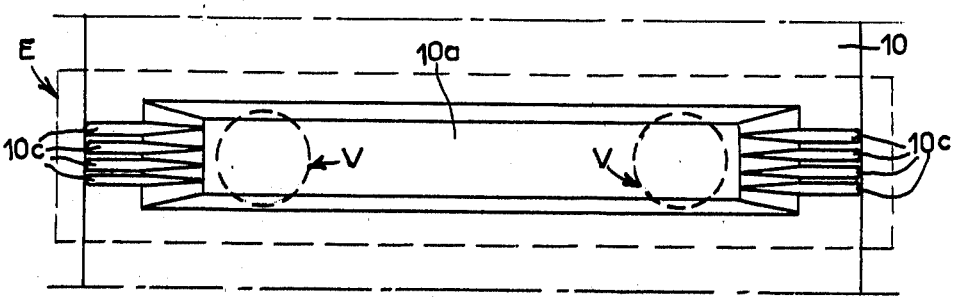
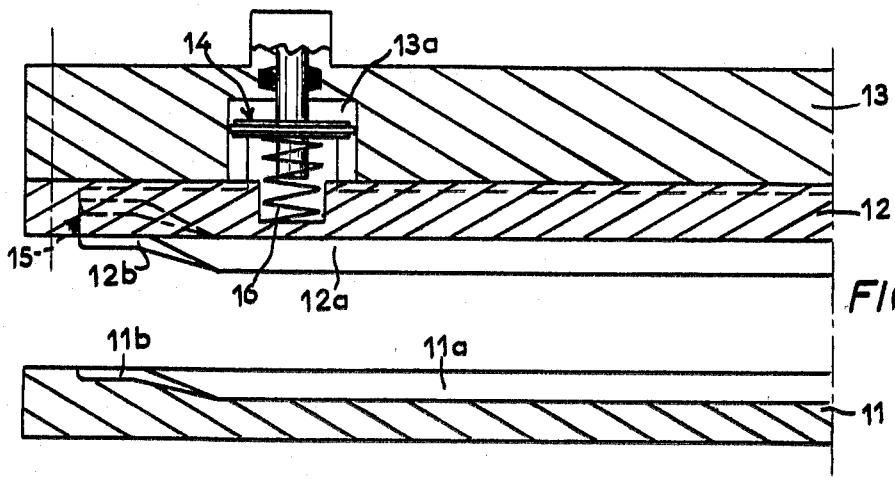
FIG.14

METHOD FOR MANUFACTURING METALLIC RIBS ON SHEET STOCK

BACKGROUND OF THE INVENTION

The object of the present invention is the disclosure of a method and apparatus for the manufacture of metallic sheet stock having ribs and the structure obtained thereby.

The invention pertains to the art of metalworking without substantial removal of material.

In bodywork, metalwork and building, upstanding ribbed or corrugated metallic structures are currently used in panels, racks, vans, containers, doors, portals, shelters and other articles and devices.

Such metal sheet stock have one or more stiffening ribs or, conversely, grooves, according to the dimensions thereof, and are obtained from a roll of material, by successive operations such as peeling, planing, cutting, press folding, etc.

At this time, in this type of structure, the ribs or grooves are longitudinally executed on the entire surface of the sheet, in other words they may be said to open on both sides of the structure.

In certain uses, structures which are assembled together have their ribs opening to the outside. These openings can receive all sorts of objects which are placed therein; water, snow, and dust can slip in and damage the material with time.

It has been heretofore proposed to plug such openings, but that necessitates a costly complementary operation which can destroy the esthetic factor and which slows the production of the work. One other method of plugging the grooves would be difficult due to the fact that it would be necessary to use enormous and very powerful presses.

SUMMARY OF THE INVENTION

The process according to the present invention avoids many of these difficulties in the sense that with relatively simple tooling which is adapted to existing presses, closed ribs or ribs which do not open to the outside are obtained on structures or in flat sheets, by simple extrusion of the material between a punch and a matrix, without stretching of the material or undue deformation of the structure.

The process consists of pressing the structure, i.e., the flat sheet between a punch and a matrix supported on a folding press, and wherein complementary profiles assure the formation of a rib which is swaged by extrusion attached to the surface of the structure, i.e., the flat sheet by a predetermined angle. The deformation produces one or more folds, corrugations or similar forms, with absorption of the excess of swaged material, in order to retain the same exterior dimensions of the structure between the swaged part and the web connecting part.

According to another embodiment, particular improvements are brought to obtaining the folds or other similar structures, particularly in obtaining improved relative flatness of the structure and in decreasing the force necessary to execute the folds, thus making the overall device less costly and more efficient.

For that, folds or corrugations are produced at the closed ends of the ribs, in a plurality of operations, in other words, by forming these folds in a series of steps. For example, if four folds are to be executed, a first punch will form two folds, ribs, or indentations, and then a second operation will form the remaining two others. If more than four folds are desired, they are fabricated in several series of two. For this, the punch support has one stationary punch and at least one movable punch, each forming two folds or corrugations.

BRIEF DESCRIPTION OF THE DRAWINGS

FIG. 1 is a perspective of a partial panel or sheet having ribs according to the prior art.

FIG. 2 is a perspective of a partial sheet having ribs or corrugations according to the invention.

FIG. 3 is a partial planar view of a sheet according to the invention.

FIG. 4 is a cross section along the line 4—4 of FIG. 3 of the ribbed sheet.

FIG. 9 is a perspective showing a panel having ribs with folds as in another embodiment.

FIG. 10 is a planar view of a part of the panel having at least one rib or corrugation.

The broken lines diagrammatically represent the position of the control jacks of the movable punches.

Figure 11:
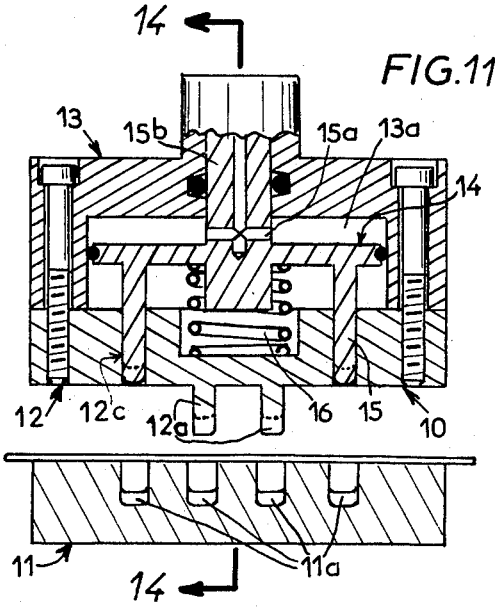
Figure 12:
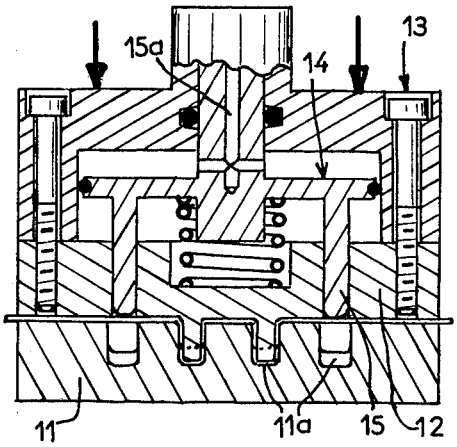
Figure 13:
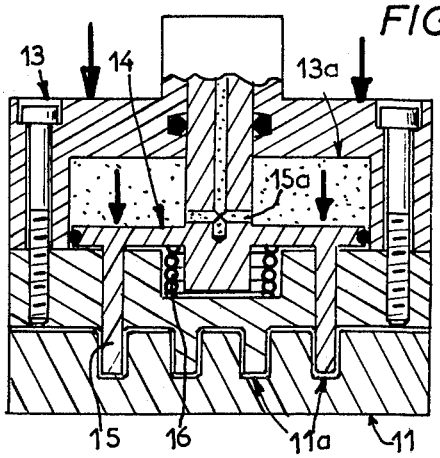

FIGS. 11, 12 and 13 are transverse cross-sections of the stationary and movable punches for formation of the folds in three different successive phases.

FIG. 14 is a longitudinal cross-section along the line 14—14 of FIG. 11.

Figure 15:
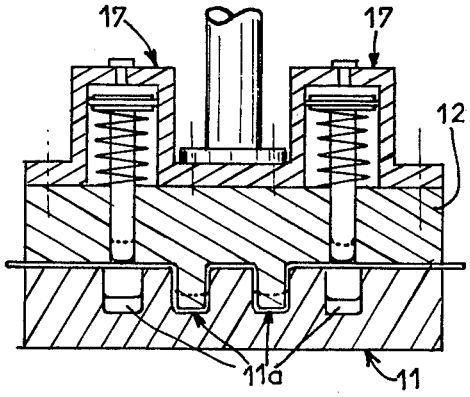

FIG. 15 is a transverse cross-section of another embodiment of the movable punch control.

Figure 16:
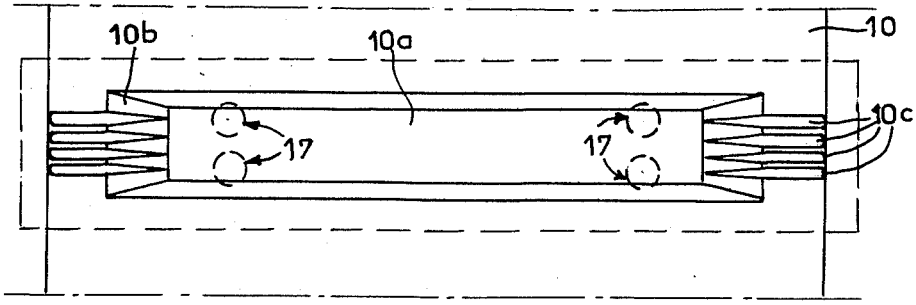

FIG. 16 is a planar view of a part of the ribbed panel on which is shown in broken lines the position of the movable punch control jacks as in FIG. 15.

DETAILED DESCRIPTION OF THE INVENTION

FIG. 1 shows fragmentally and, as an example, a panel P, produced according to the prior art, in other words with ribs or grooves $P_1$ formed by conventional folding, with open ends.

In the present invention, closed ribs or corrugations are realized wherein at the ends of the panel or other metallic structure there are no openings.

FIG. 2 shows, for example, a panel 1 having upstanding ribs 1*a* which connect to the flat surface of the panel by an incline portion 1*b*.

To collect the metal which has been upset during the operation of formation of the aforementioned ribs and to prevent it from stretching out on the flat surface, it has been forced to form a certain number of smaller folds or mini-corrugations 1*c* beginning at the base of the ribs 1*a* and ending at the edge of the panel or in another embodiment on the open sheet itself in the event that the so-called mini-corrugations terminate far from the edge of the panel.

The quantity of these smaller folds of mini-corrugations are determined as a function of the amount of material to be accounted for, which in other words is a function of the depth of the rib and its other dimensions.

As shown on the structure 2 of FIG. 3, these smaller folds or mini-corrugations 2*a* allow for a side B along the flat surface of the structure which is equal to the dimension side A at the rib 2b.

When the smaller folds or mini-corrugations 3a of ribs 3b end at the edge of a structure or a panel 3, the connection occurs by a rounding-off portion 3c thereby completely closing the rib as noted in FIG. 4. If the rib is in a flat sheet, the connection with the flat surface can be progressive up to the level of said surface.

To produce these mini-corrugations, a simple and not very complicated tooling is used, as elucidated in FIGS. 5 to 8. Furthermore, the apparatus hereinafter disclosed is adapted to current folding or corrugation presses.

Figure 5:
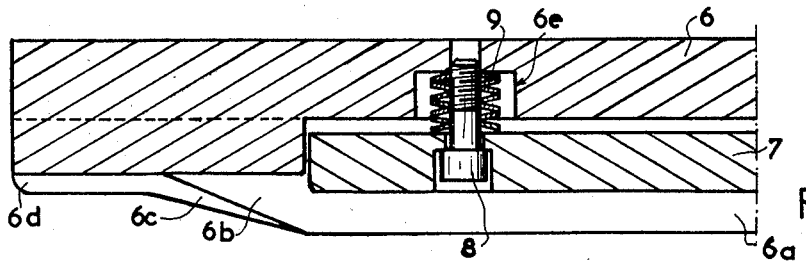
FIG. 5 is a fragmentary cross-section of the punch for formation of the rib according to the invention.
Figure 6:
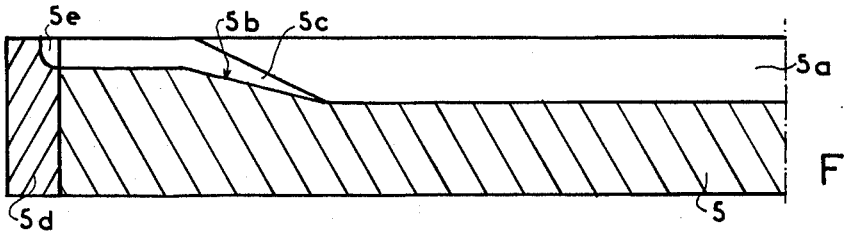
FIG. 6 is a fragmentary cross-section of the corresponding matrix or anvil portion.
Figure 7:
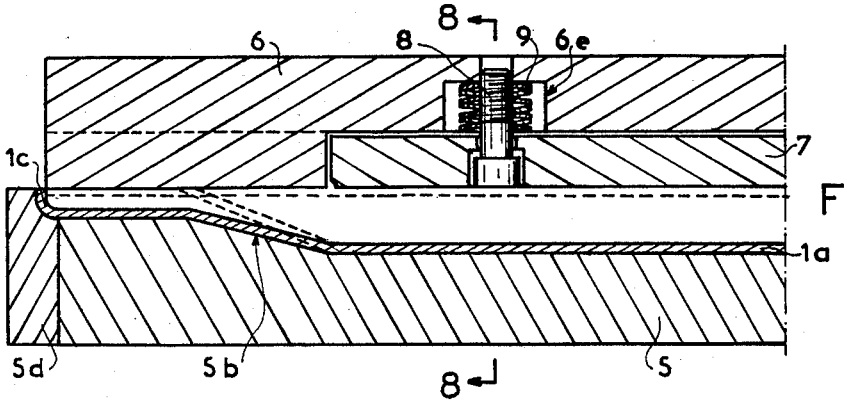
FIG. 7 is a fragmentary cross-section showing the punch and the corresponding anvil at completion of the operation of formation of a rib.
Figure 8:
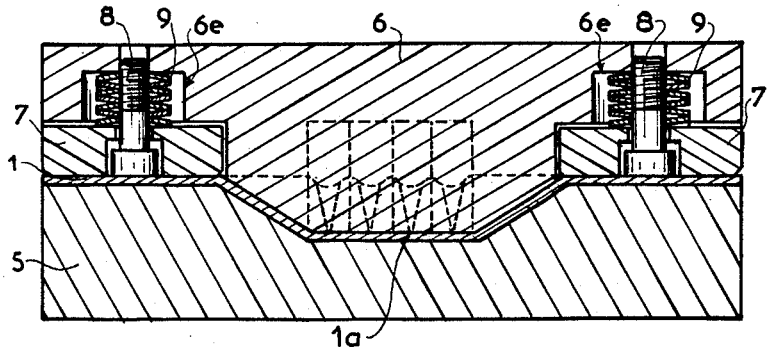
FIG. 8 is a transverse cross-section along the line 8—8 of FIG. 7.

An anvil 5 has a cavity 5a for formation of the rib, which extends through an incline portion 5b provided with triangular longitudinal projections 5c for placing thereinto as can be seen from FIG. 6. An end portion 5d of the anvil portion is preferably joined to the external end to constitute the terminal concave rounded-off shoulder portion 5e.

The punch 6 has a projection portion 6a which is mating complementary to the cavity 5a of the anvil portion, for formation of the rib, which extends through an incline 6b, equipped with triangularly shaped grooves 6c which are complementary to the aforementioned projections 5c of the anvil and which terminate with a convex rounded-off portion 6d which corresponds to the concave rounded-off shoulder portion 5e of the anvil.

To permit the metal to be easily upset into the various dispositions of the punch and the anvil without being squeezed outwardly, it is necessary to firmly hold the panel or structure on either side of the major rib. For that purpose, adjustable clamping means are provided in the form of and including contact plates 7 mounted on the punch by screws 8 or similar means, and by interposing flexible and resilient means 9 between the rear face of plate 7 and the base of a punch seat 6e, these being coil springs or other elements with equivalent flexible and resilient capacity.

The ribs which are produced by the present invention may have either two closed ends, i.e., closed at both ends, or only at one, as desired. Furthermore, the corrugations can have any sectional form.

Of course, when the panels or structures are assembled together and with other elements to form an enclosed housing container or the like, no opening appears at the ends, which avoids any dirtying, or deterioration due to the natural elements in the environs. Prior art ribs which open outwardly do not possess the aforementioned advantages. Furthermore, the panels or structures of the present invention may be essentially constructed and fabricated at the same price, with further savings as no closure at the ends are required.

FIG. 9 shows a completed panel 10 which has ribs 10a connecting to its planar surface by inclines 10b.

It is to be recalled that to assemble the metal which has been upset during the closing operation when the partially sloping mini-corrugations are formed, it is necessary to form a certain number of folds or mini-corrugations 10c beginning at the base of the ribs and extending to the edge of the panel and out on the flat portion of the sheet.

According to the variation, the folds are formed in a plurality of operations. In the example shown, there are four folds. They are formed two by two, in other words, first the central folds and then the lateral folds. Of course, it is not impossible to form the folds one at a time, or even three by three.

FIG. 10 shows a part of panel 10 in which a rib 10a has folds 10c at the ends of the rib 10a. This view shows diagrammatically the punch-anvil assembly E as well as clamping means V to control the movable punches. This assembly is illustrated in more detail in FIGS. 11 to 14, where an anvil 11 is shown with longitudinal cavities 11a for the formation of the mini-corrugations (FIG. 14) and the end parallel cavities 11b for formation of the folds.

The support 12 for the punch has longitudinal projections 12a with end forms 12b which are complementary to cavities 11b of the matrix. These projections are integral with the punch support 12 and correspond to the central cavities of the anvil.

On the punch support 12 is attached a hollow body 13, having cylinders 13a in which pistons 14 move connected with two punches 15, which pass through the punch support 12 through suitable openings 12c and which are situated in the alignment with cavities 11b at the sides of the anvil (FIG. 11).

These pistons are of either single or double effect. Single effect pistons are shown in the drawings powered by a fluid introduced into the cylinders through orifices 15a of shaft 15b of the pistons. The pistons are normally urged upwardly by coil springs 16, for instance.

The process for producing the mini-corrugations is now described relative to FIGS. 11, 12 and 13, which are cross-sections of such mini-corrugations.

FIG. 11 shows the punch support in an at rest position and above the anvil with the movable punches withdrawn in the punch support. A panel 10 is in position on the anvil.

In the first press engagement, the punch support 12 is lowered for first pressure contact on the anvil on which the panel has been placed to form the two first folds, see FIG. 12. It is to be noted that the sides of the presses can be provided as in the preceding embodiment, but it is not absolutely necessary, because the force needed is less here.

While maintaining the pressure on the matrix to avoid deformation of the panel, the fluid is sent into the cylinder assuring the thrust of lateral punches 15 on the panel which in turn is thrust into the lateral cavities of the anvil, see FIG. 13, to provide the second set of mini-corrugations.

When the desired mini-corrugations are formed, the pressure of the punch support is released and the fluid pressure in the cylinder is released which then results in the withdrawal of punches 15 in response to the action of spring 16.

FIGS. 15 and 16 show another embodiment of the apparatus for carrying out the method of the invention wherein there are four hydraulically operating cylinders 17; in other words, two for each lateral punch.

Of course, other movable punch control means can be introduced without exceeding the limitations of the invention. For example, the punches can be connected to angle or cam systems or even to eccentric devices.

In this variation, it is to be noted, besides the advantages described above the following points: the operation, in at least two parts, leads to a reduced absorption of the material each time, which permits reduction of the power of the press, and thus leads to its cost effectiveness, and to limitation of the deformations of the metal, which allows deletion of the side presses.

What is claimed is:

1. The process of forming a sheet at low pressure to produce therein a longitudinal corrugation having a major length of large cross-section and having ends of minor length which gradually taper from the large cross-section of the major length into the plane of the sheet, the outermost ends of the tapered ends stoping substantially short of the adjacent ends of said sheet, said process comprising:

forming the major length and the two tapered minor lengths of said longitudinal corrugation between matched male and female die members by closing and pressing said die about said sheet;

whereby excess sheet material tends to be present in the region of the sheet longitudinally extending from the ends of the longitudinal corrugation to the adjacent edge of the sheet and whereby said excess material in said region tends to produce wrinkles;

forming a plurality of parallel mini-corrugations in said region with the length of each mini-corrugation being parallel to the length of the longitudinal corrugation and each mini-corrugation being located so that it intersects one of said tapered ends;

whereby said mini-corrugations absorb said excess material while protruding from the plane of said sheet only a minor fraction of the corresponding protrusion of said longitudinal corrugation; and whereby the corrugated sheet produced by the process does not wrinkle from excess material in said region, and will, with the corrugation protruding upwardly from the plane of the sheet, lie flat.

2. The process of claim 1 in which the step of forming the major length and the tapered minor lengths of said longitudinal corrugation occurs simultaneously with the step of forming at least one of the plurality of parallel mini-corrugations.

3. The process of claim 1 in which the step of forming the major length and the tapered minor lengths of said longitudinal corrugation occurs sequentially with the step of forming at least one of the plurality of parallel mini-corrugations.

4. The process of claim 1 in which the mini-corrugations which intersect a tapered end are all formed simultaneously.

5. The process of claim 1 in which at least two of the mini-corrugations which intersect a tapered end are formed sequentially.

6. The process of claim 1, including further: retarding said sheet, during the said step of forming, from sideways motion in the plane of the sheet by application of friction producing pressure, said presure being applied to said sheet at zones thereof disposed equally spaced on opposite sides of and parallel to said longitudinal corrugation.

7. The process of claim 1 including further: shifting said sheet in the plane thereof and in a direction perpendicular to the longitudinal corrugation an amount sufficient to position an unformed portion of the sheet at the site of said forming between said matched male and female dies; and repeating the steps of claim 1; whereupon more than one corrugation is formed in said sheet; and thereupon repeating these steps till the desired number of corrugations have been formed.

8. The process of claim 1 in which a plurality of parallel spaced longitudinal corrugations are simultaneously formed in accordance with the steps of claim 1.

9. The process of claim 1 including further pressing down only the extreme outer ends of said mini-corrugations an extent sufficient to place the extreme outer edges of the mini-corrugations in the plane of the unformed sheet.

10. The process of claim 1 characterized further by the said excess material being absorbed so completely by said mini-corrugations that the overall dimensions, in the plane of the sheet, of length and width, are substantially the same for the unformed and the formed sheet.

11. The process of claim 6, whereby the overall dimensions, in the plane of the sheet, of length and width, are substantially the same for the unformed and the formed sheet.

* * * * *